US006821095B2

(12) United States Patent
Dooley et al.

(10) Patent No.: US 6,821,095 B2
(45) Date of Patent: Nov. 23, 2004

(54) PORTABLE AIR CIRCULATION DEVICE

(75) Inventors: Thomas J. Dooley, Springfield, PA (US); Robert Boohar, Gap, PA (US); Anatoly I. Muchnik, West Chester, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 0 days.

(21) Appl. No.: 10/236,265

(22) Filed: Sep. 5, 2002

(65) Prior Publication Data

US 2004/0047743 A1 Mar. 11, 2004

(51) Int. Cl.[7] ..... F04B 35/04; F04B 53/00

(52) U.S. Cl. ..... 417/234; 417/423.1; 417/423.15; 416/63; 415/126

(58) Field of Search ..... 417/234, 423.7, 417/423.15, 411, 423.1; 415/126, 127; 416/247 R, 246, 244 R, 63, 146 R, 142, 204 R

(56) References Cited

U.S. PATENT DOCUMENTS

| | | | | | |
|---|---|---|---|---|---|
| 2,116,539 | A | * | 5/1938 | Payne et al. | 230/133 |
| 2,278,082 | A | * | 3/1942 | Lofgren | 230/117 |
| 2,633,293 | A | * | 3/1953 | Jones | 230/259 |
| 2,857,095 | A | * | 10/1958 | Suarez Grau | 230/273 |
| 3,120,340 | A | * | 2/1964 | Strumpell | 230/117 |
| 3,306,527 | A | * | 2/1967 | Cook | 230/127 |
| 3,500,738 | A | | 3/1970 | Wenig | |
| 3,667,872 | A | | 6/1972 | Norman | |
| 4,424,006 | A | * | 1/1984 | Armbruster | 417/234 |
| 4,483,664 | A | * | 11/1984 | Armbruster | 417/234 |
| 4,954,049 | A | | 9/1990 | Armbruster | 417/234 |
| 5,404,614 | A | * | 4/1995 | Stephens | 15/327.2 |
| 5,658,195 | A | | 8/1997 | Marvin et al. | |
| 6,244,823 | B1 | * | 6/2001 | Marino et al. | 416/246 |

FOREIGN PATENT DOCUMENTS

| | | |
|---|---|---|
| NL | 6508014 | 12/1966 |
| WO | WO 01 40714 | 6/2001 |

OTHER PUBLICATIONS

International Search Report PCT/US03/26955, dated Jan. 2, 2004.

* cited by examiner

*Primary Examiner*—Charles G. Freay
(74) *Attorney, Agent, or Firm*—RatnerPrestia

(57) ABSTRACT

A portable electrical blower assembly is provided. The portable electrical blower assembly has a pair of wall members; a motor control assembly coupled to a surface of one of the wall members, the motor control assembly including a motor control housing; a motor adjacent the motor control assembly and coupled thereto; and an air director disposed between the pair of wall members, the air director being rotatable with respect to the pair of wall members and the motor.

56 Claims, 9 Drawing Sheets

PORTABLE AIR CIRCULATION DEVICE

FIELD OF THE INVENTION

This invention relates to air circulation devices. More specifically, the present invention relates to a portable air circulation device in which the air director is rotatable with respect to a supporting wall structure and motor.

BACKGROUND OF THE INVENTION

A variety of air circulation devices are known in the prior art, and typically comprise a motor-driven impeller for drawing air at a relatively high rate through a flow path. A vent or grill provides an inlet to the flow path whereby air is drawn by an impeller into the flow path for redirection and output through a port.

The prior art includes blower assemblies that have complex construction wherein the motor controls and associated wiring are located remotely from the blower motor. Not only does this increase costs of production, but the flexing and associated strain on the wiring between the motor and associated control devices provide a point of failure. Furthermore, in certain of the prior art, motor control and wiring to the motor are located within the carrying handle increasing the risk of shock due to either a failure of the insulation of the exposed wiring or improper handling by the user. Finally, the prior art limits the degree by which the outlet air may be directed.

The present invention overcomes the problems and disadvantages of the prior art can be readily positioned for airflow and the direction maintained or varied as desired, and which provides other positive advantages.

SUMMARY OF THE INVENTION

In view of the shortcomings of the prior art, the present invention provides a portable electrical blower assembly.

According to one aspect of the present invention includes a least a pair of wall members; a motor control assembly coupled to a surface of one of the wall members, the motor control assembly including a motor control housing; a motor adjacent the motor control assembly and coupled thereto; and an air director disposed between the pair of wall members, the air director being rotatable with respect to the pair of wall members and the motor.

According to another aspect of the invention, the air director is rotatable through at least 180 degrees.

According to a further aspect of the invention, the air director is rotatable through about 360 degrees.

According to still another aspect of the present invention, a detent means provides a plurality of positive stops for rotation of the air director.

According to yet another aspect of the present invention, the handle is free of electrical wiring.

According to still another aspect of the present invention, the air director rotates with respect to the handle.

According to a further aspect of the present invention, the motor control assembly includes: a motor controller and a plurality of wires connected to at least of i) the motor controller and ii) the motor.

According to still a further aspect of the present invention, the motor is stationary during a rotation of the air director.

According to yet another aspect of the present invention, the motor is mounted to the motor control assembly or to one of the wall members.

According to a further aspect of the present invention, a fan assembly coupled to the motor includes a first plurality of blades and a second plurality of blades, each blade of the respective plurality of blades spaced apart from one another in a parallel configuration, the second plurality of blades offset from the first plurality of blades by a predetermined distance.

According to yet another aspect of the present invention, a first air intake adjacent a first one of the pair of wall members provides air intake for the first plurality of blades and a second air intake adjacent a second one of the pair of wall members provides air intake for the second plurality of blades.

These and other aspects of the invention are set forth below with reference to the drawings and the description of exemplary embodiments of the invention.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures.

DETAILED DESCRIPTION

Figure 1:
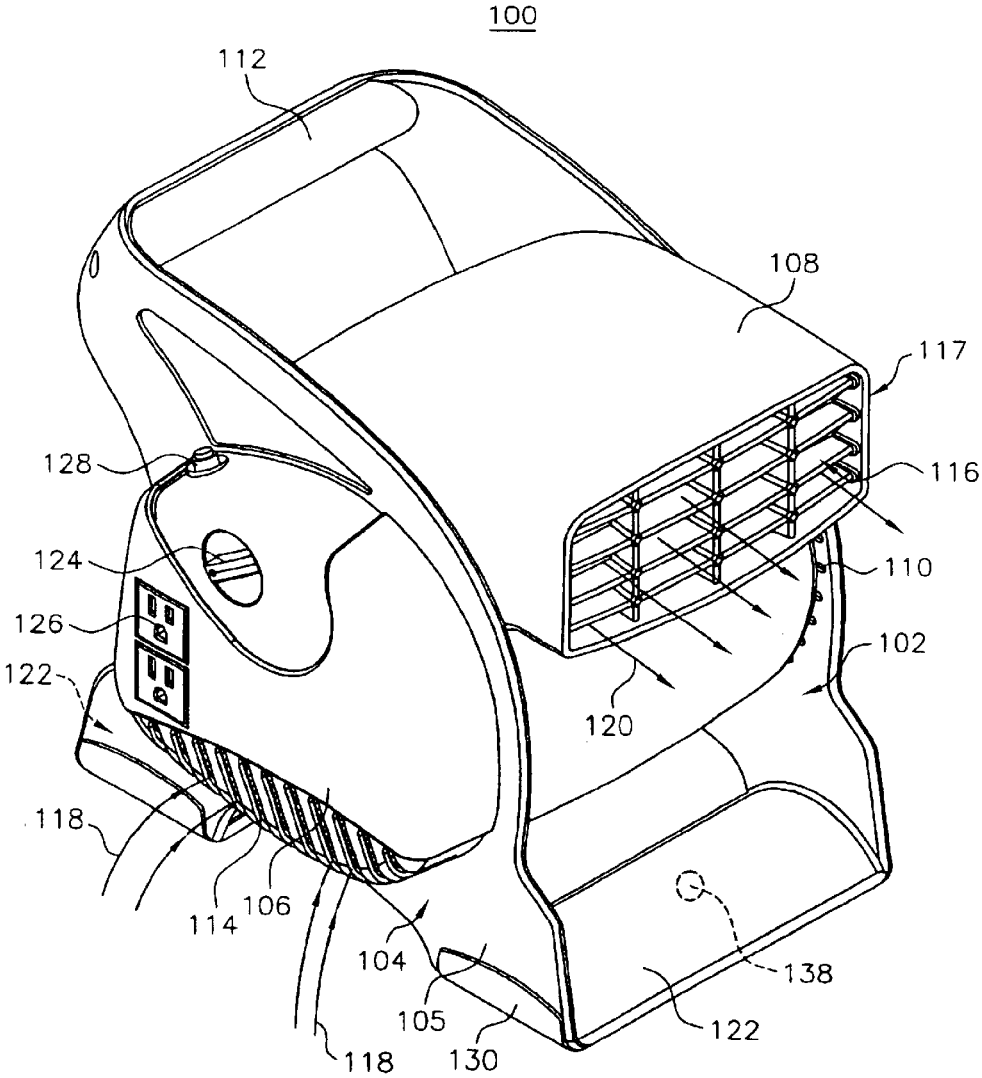
FIG. 1 is a left side perspective view of a portable air circulation device illustrating an exemplary embodiment of the present invention.
Figure 2:
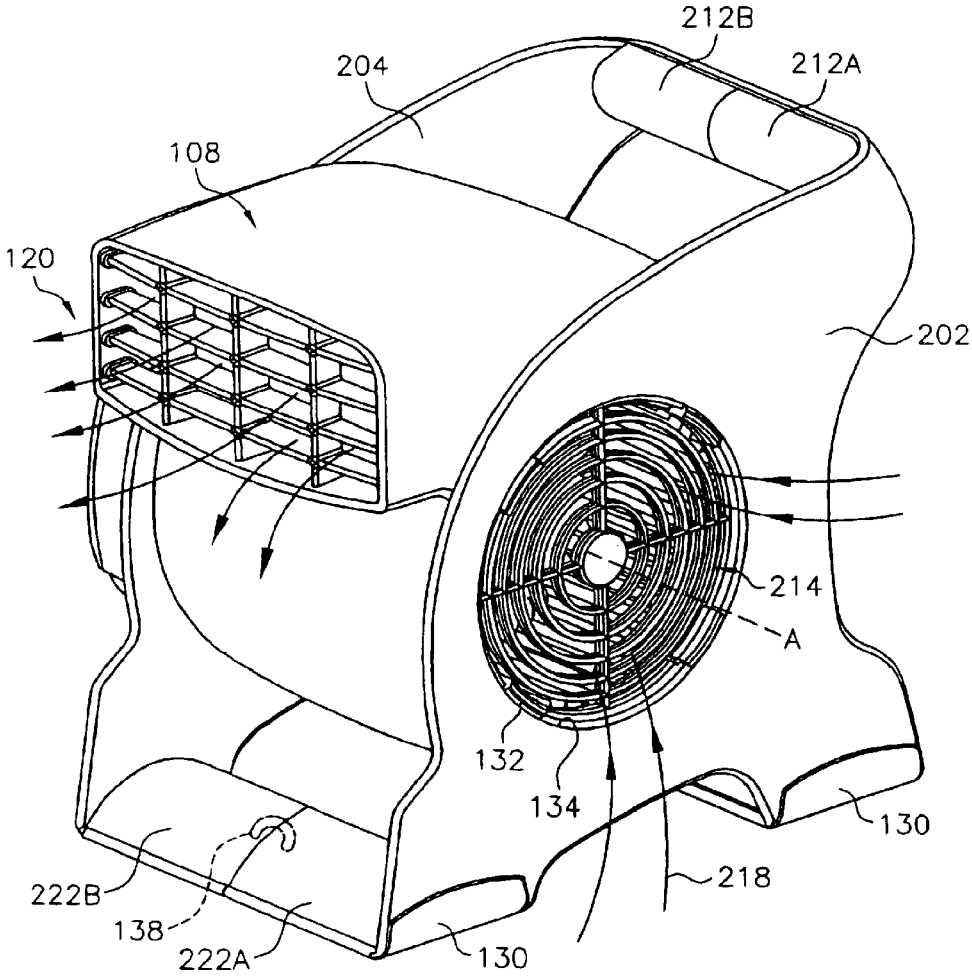
FIG. 2 is a right side perspective view of the portable air circulation device illustrating a second exemplary embodiment of the present invention.

Referring now more particularly to FIGS. 1 and 2 an exemplary embodiment of the present invention is illustrated. As shown in FIG. 1, portable air circulator 100 has a pair of wall members 102, 104. Attached to one of the wall members, for example wall member 104, is motor control assembly 106. Included in motor control assembly 106 is motor controller 124, such as a multi-position rotary switch, for example. Optionally, auxiliary power outlets 126, and a safety device 128, such as a circuit breaker, coupled to at least auxiliary power outlets 126, may be included in motor control assembly 106. At a lower potion of motor control assembly are air inlets 114 for providing a source of intake air 118 to portable air circulator 100.

Figure 4:
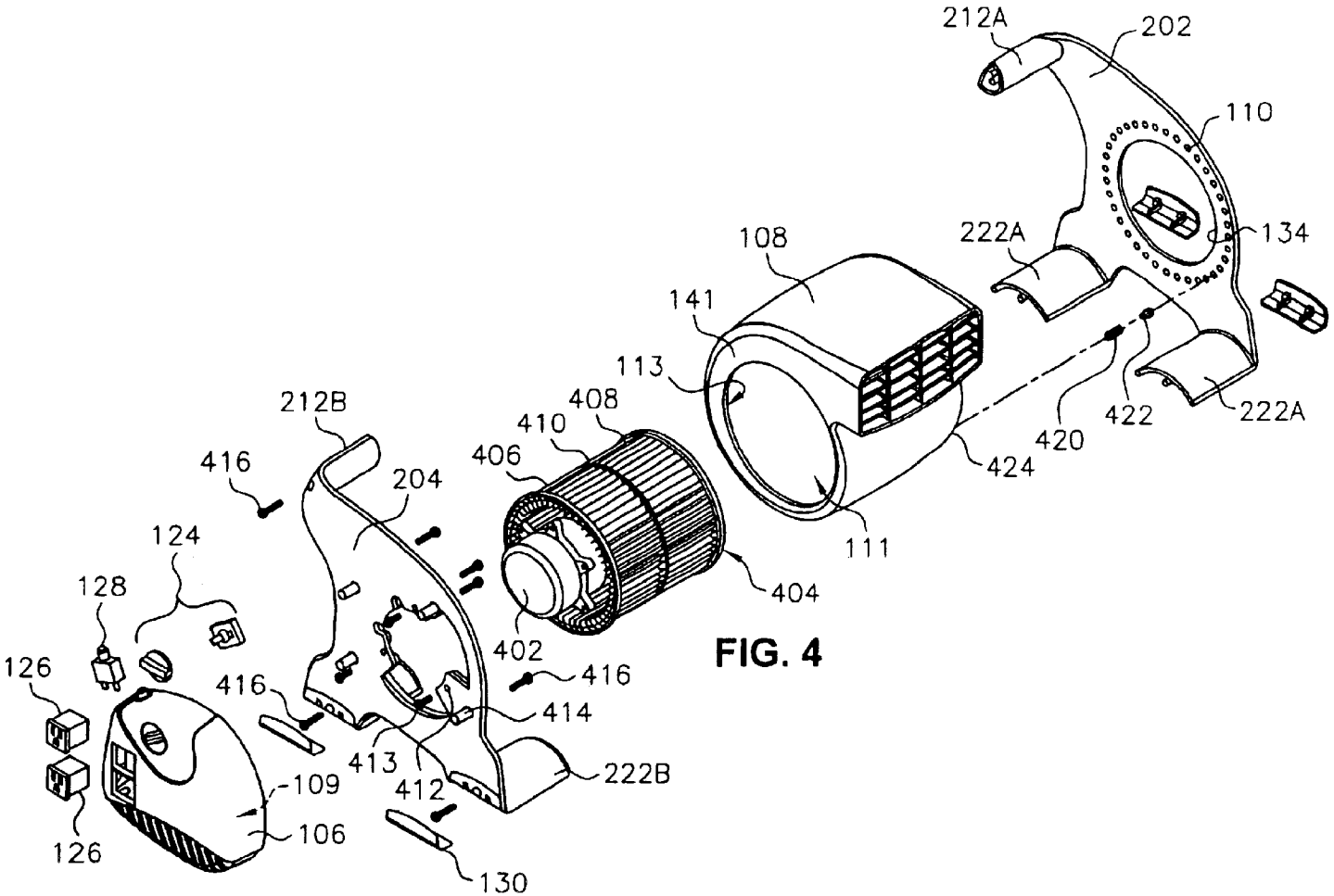
FIG. 4 is an exploded perspective view illustrating details of an exemplary embodiment of the present invention.

Portable air circulator 100 also includes a handle portion 112 coupled to wall members 102, 104. In one exemplary embodiment, handle portion 112 may be a separate part coupled to each of wall members 102, 104 with fasteners, such as screws, adhesives, etc. Alternatively, handle portion 112 may be formed as a part of either wall member 102, 104 and extend to engage the opposite wall member. In a similar manner, mounting base 122, positioned at a lower portion of wall members 102, 104 and at a front and rear portion thereof, may be separate parts extending between and engaging each of wall members 102, 104, or formed as a part of either wall member 102, 104 and extend to engage the opposite wall member. Alternatively, and as shown in FIGS. 2 and 4, handle portions 212A, 212B and mounting portions 222A, 222B, may be formed as part of wall members 202, 204, respectively. In either approach, wall members 102 and 104 or 202 and 204 are joined together with a joining means, such as fasteners 416 (best shown in FIG. 4), adhesives, etc.

Referring again to FIG. 1, mounting feet 130 may also be attached to the lower portion of wall members 102, 104, 202, 204. In an exemplary embodiment, mounting feet 130 may have a non-skid characteristic to inhibit unintentional movement of portable blower assembly 100 during operation, for example. Additionally, positioner 136, such as wheels, (best shown in FIG. 6) for example, may be provided at the lower portion of mounting base 122/222. Positioners 136 may be placed at either or both the front and/or rear of portable air circulator 100 to facilitate moving air circulator 100 along a surface. It is also contemplated that positioner 136 may include a lock (not shown) to prevent unintentional movement of air circulator 100.

In an alternative embodiment, mounting base 122/222 may include a mounting point 138, such as a through hole or blind hook/hanger, for example to facilitate fixedly mounting air circulator 100 to a surface, such as a wall, inclined floor, or table, for example.

Air director 108, having a generally rectangular outlet 117, is positioned between wall members 102, 104. Air director 108 is rotatable about axis A to provide outlet air 120 as needed in a direction generally orthogonal to axis A (best shown in FIGS. 2 and 7). Outlet 117 may include grill work 116 therein, such as louvers, to aide in the control of outlet air 120 and/or to prevent foreign objects, such as body parts, from entering air director 108 and engaging with fan blade assembly 404 (best shown in FIG. 4). In an exemplary embodiment, louvers 116 are fixed within outlet 117, but the invention is not so limited. It is contemplated that louvers 116 may be repositionable along either or both the horizontal and/or vertical axes to redirect outlet air as desired.

It is contemplated that wall members 102 and 104, motor control housing 106, and air director 108 are constructed from a polymer, although other types of materials may be used as well to form any of the various parts of portable air circulation device 100.

Figure 7:
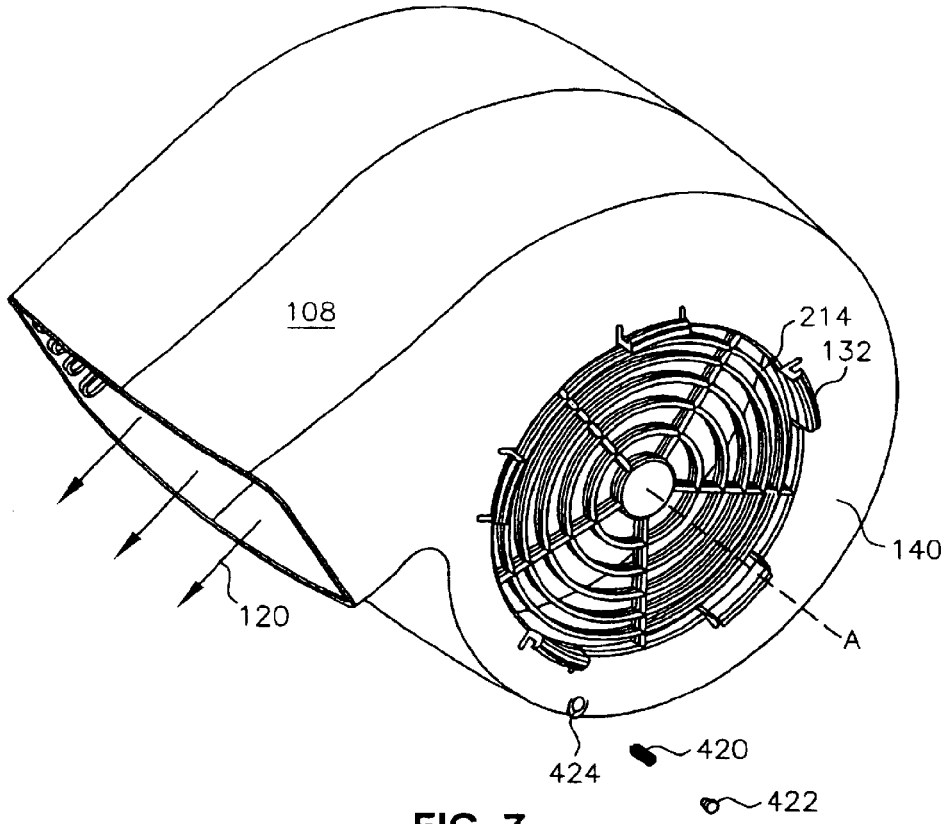
FIG. 7 is a right side perspective view of the air director according to an exemplary embodiment of the present invention.

Referring now to FIG. 2, to facilitate the rotation of air director 108 about axis A, hold-downs 132, such as hooks or clips for example, are provided along the periphery of inlet grill 214, which is provided at a generally central portion of side portion 140 of air director 108 (best shown in FIG. 7). In an exemplary embodiment, inlet grill 214 is formed as a unitary part of side portion 140. Hold-downs 132 engage guide 134, having a generally circular shape, provided in a portion of sidewall 102 (shown in FIG. 1) or sidewall 202 (shown in FIG. 2). On the opposite side of air director 108, a seat 113 having a generally circular shape is formed at a central portion of side portion 141 (best shown in FIG. 4) of air director 108 (best shown in FIG. 4). A mating shoulder 224 is formed in sidewall 204 (best shown in FIG. 5) to engage with and fit within seat 113.

Figure 6:
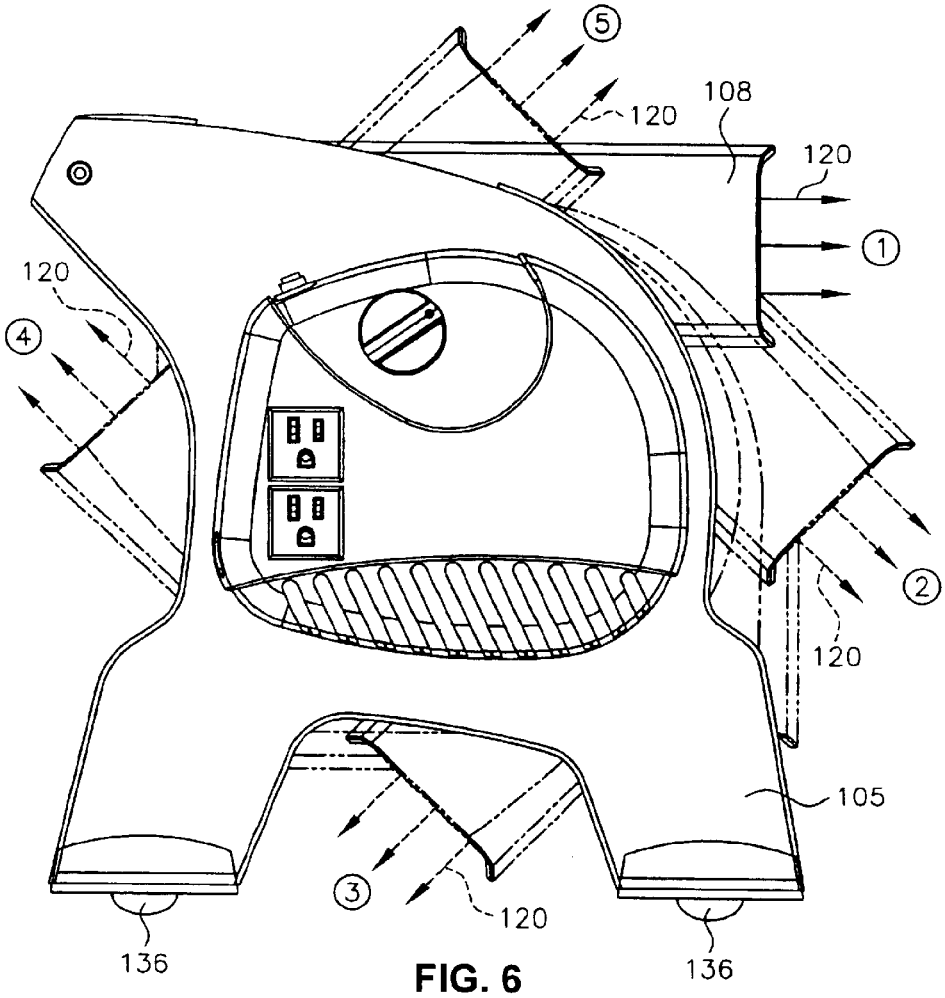
FIG. 6 is a side view of an exemplary embodiment of the present invention illustrating rotational movement of the air director.

In this way, and as shown in FIG. 6, air director 108 may be rotated through 360 degrees into any desired position, such as those depicted as position 1, 2, 3, 4, and 5, for example in FIG. 6. Further, air director 108 rotates with respect to the sidewall members 102/202 and 104/204, handle portion 112, and motor control assembly 106. In an exemplary embodiment, hold-downs 132 may be resilient to allow for ease of assembly during engagement of air director 108 with sidewall member 102/202.

The rotation of air director 108 may be limited to less than 360 degrees if desired by either increasing the length of outlet 117 and/or shortening the length of extension portion 105 of wall members 102, 104 (or 202, 204) such that outlet 117 interferes with base 122 in the front and/or the rear of the assembly. As a result, the rotation of air director 108 may be limited to about 270 degrees. Furthermore, stops (not shown) may be provided at a desired position along side wall member 102, 104, for example to restrict the rotation of air director 108 to a desired angular limit and/or direction.

Referring again to FIGS. 1, 4 and 7, in an exemplary embodiment, a plurality of detents 110 may be placed in either or both wall members 102/202, 104/204. A mating element, such as positioner 422, having a generally rounded end, may be disposed in air director 108 within a space 424 in a side portion 140 thereof, and under the force of spring 420 urged to engage one of the plurality of detents 110 to provide positive stops (as well as tactile and audible feedback if desired) as air director 108 is rotated into a desired portion. In one exemplary embodiment, detents 110 are placed along the periphery of guide 134 at intervals of about 10 degrees, for example. The invention is not so limited, however, as it is contemplated that detents 110 may be spaced at intervals of between 5 and 15 degrees, if desired, or may be provided at predetermined random positions. Furthermore, although the example provides for detents 110 to be placed in a wall member, it is also contemplated that detents 110 may be placed in air director 108, along one or both side walls, and the mating element 422 and spring 420 may be located within an adjacent wall member.

Figure 3:
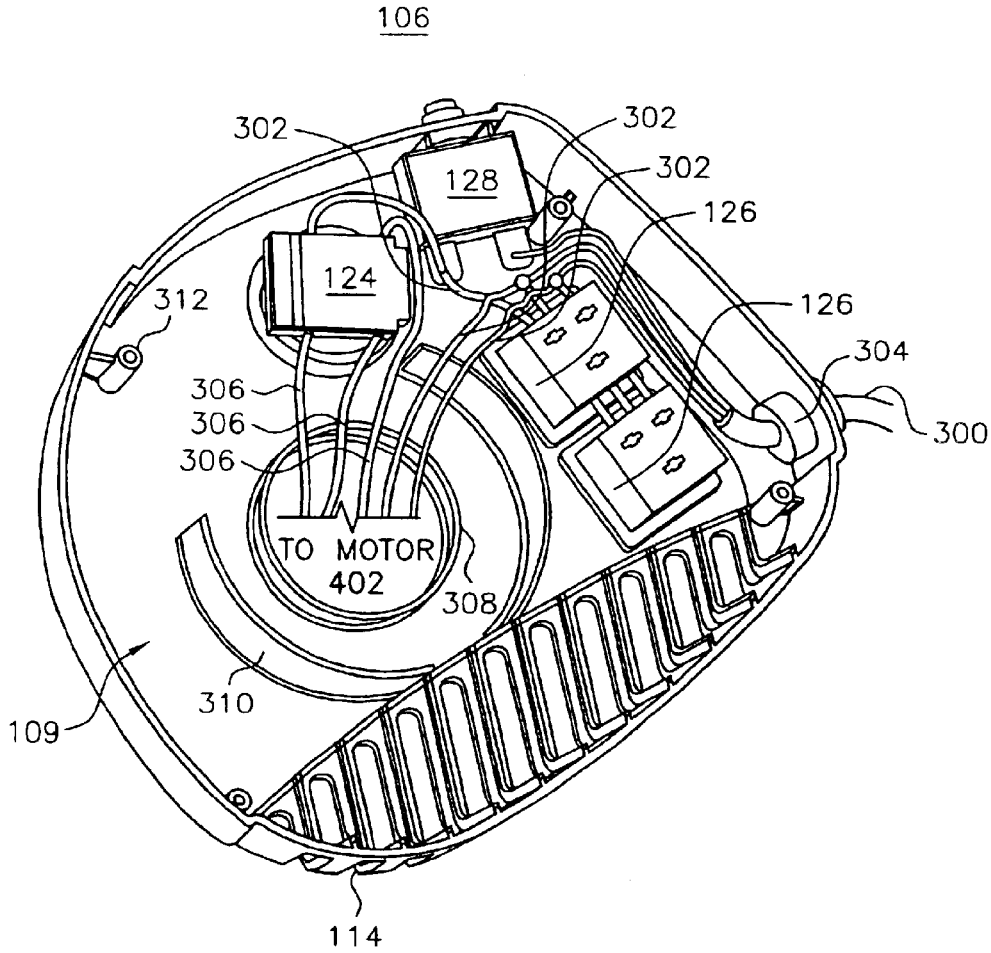
FIG. 3 is an inside perspective view of a motor control assembly of the exemplary portable air circulation device.

Referring now to FIG. 3, a perspective view of the inside of motor control assembly 106 is illustrated. As shown in FIG. 3, motor control assembly 106 has an interior space 109. Within interior space 109 is spacer 308, having a generally circular configuration, to provide a surface on which the rear of motor 402 (not shown in this figure) can rest if needed, and motor support 310, having a generally semicircular configuration, for maintaining motor 402 in position within motor control assembly 106. In addition, motor control assembly 106 includes motor controller 124, such as a multi-position rotary switch, for example, and power cord 300 held in place by strain relief 304, such as those well known in the art. Optionally, motor control assembly 106 may include one or more auxiliary power receptacles 126 and a safety device 128, such as a circuit breaker, coupled to and in series with at least one side of auxiliary power receptacles 126.

Wiring 302 between the various electrical components and power cord 300, and wiring 306 between motor controller 124 and motor 402 (not shown in this figure) is contained within interior space 109 of motor control assembly 106 and are substantially stationary during rotation of air director 108. As can be appreciated by those of skill in the art, this has the advantage of preventing exposure of wiring between the motor and its controller to the environment, as well as eliminating the flexing of motor control wiring during rotation of the air director or the possibility of snagging the motor control wiring on objects during transportation or use. Furthermore, configuring motor control assembly 106 in this way allows for an absence of electrical wiring in handle 112, such as that required in certain conventional portable air circulation devices.

Figure 5:
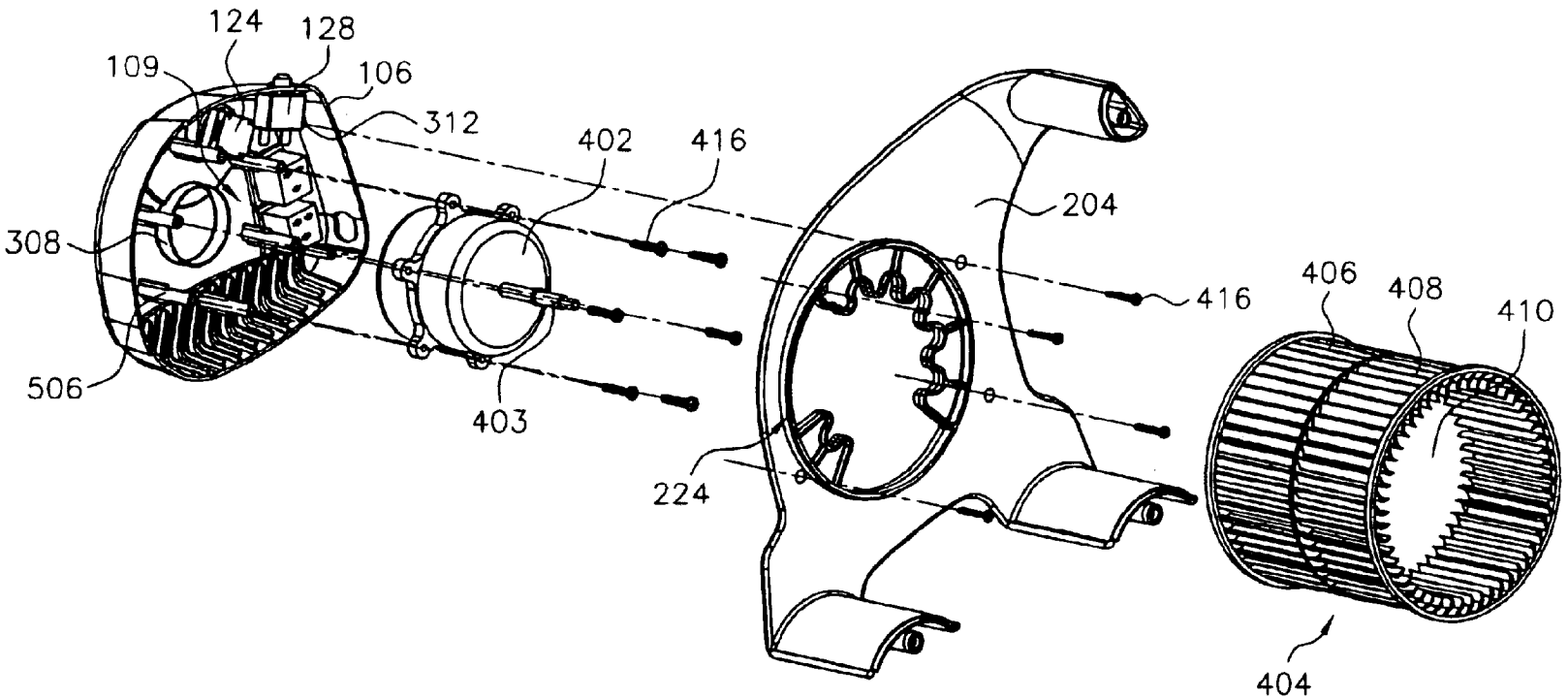
FIG. 5 is an exploded perspective view illustrating details of a further exemplary embodiment of the present invention.

Referring again to FIG. 4, motor 402 may be fixedly mounted to wall member 204 (or 104), such as at an inner portion thereof, for example, using fasteners 413, such as screws, through mounting holes 412. Alternatively, and as shown in FIG. 5, motor 402 may be mounted to motor control assembly 106 at mounting bosses 506 using fasteners 416, such as screws. In this latter approach it may not be necessary to include motor support 310 (shown in FIG. 3). In either approach, however, motor 402 is collocated with motor controller 124 and is fixed with respect to air director 108, such that air director 108 may be rotated into a desired direction without effecting i) the position of motor 402 or ii) the wiring associated with motor 402 and motor controller 124 (best shown in FIG. 3). Further, motor 402 is at least partially housed within interior space 109 of motor control assembly 106.

As shown in FIG. 4, motor control assembly 106 may be coupled to an exterior portion of wall member 104/204 with fasteners 416, for example, passing into boss 414 and into mounts 312 (best shown in FIG. 3) of motor control assembly 106. In an alternative embodiment, motor control assembly 106 may include resilient members that engage with mating members, such as slots, formed within sidewall 104/204, in snap-fit engagement.

Referring now to FIG. 5, motor 402 includes shaft 403 that rotates upon the application of electrical energy to motor 402. Fan blade assembly 404 is coupled to shaft 403 at fan blade wall 410 using conventional means. Fan blade assembly 404 may have one or more sets of blades 406, 408 that provide a flow of air therefrom and into the interior portion of outlet 117 upon rotation of motor shaft 403. Blades 406 (and/or 408) are substantially parallel to one another and have a predetermined angular pitch based on a desired airflow requirement.

In the exemplary embodiment in which there are two set of fan blades 406, 408, fan blade wall 410 forms a separation between the sets of fan blades 406, 408, at an inner portion of fan blade assembly 404. Further, fan blades 406 may be offset from fan blades 408 by a predetermined pitch, such as half the spacing between adjacent blades within one set of fan blades. For example, if adjacent fan blades 406 are spaced apart from one another along the circumference of fan blade assembly 404 by 0.25 inch, the spacing between a fan blade 406 and an adjacent fan blade 408 would be 0.125 inch.

Fan blade assembly 404 and a portion of motor 402 adjacent shaft 403 are positioned within the interior portion 111 of air director 108. Air director 108 is coupled between wall members 102, 104 (or 204, 204) with the wall members fixed to one another using well-known means, such as screws, adhesives, etc.

In operation, intake air 118 flows though air inlet 114 and into the interior portion of fan blade assembly 404 adjacent fan blades 406. Similarly, in the case of a dual fan blade assembly, intake air 218 flows though air inlet 214 and into the interior portion of fan blade assembly 404 adjacent fan blades 408. As fan blade assembly 404 rotates under the control of motor 402, each of fan blades 406 and 408 (in the case of a dual fan blade assembly) generates a portion of exhaust air 120 which flows out from outlet 117.

Figure 8:
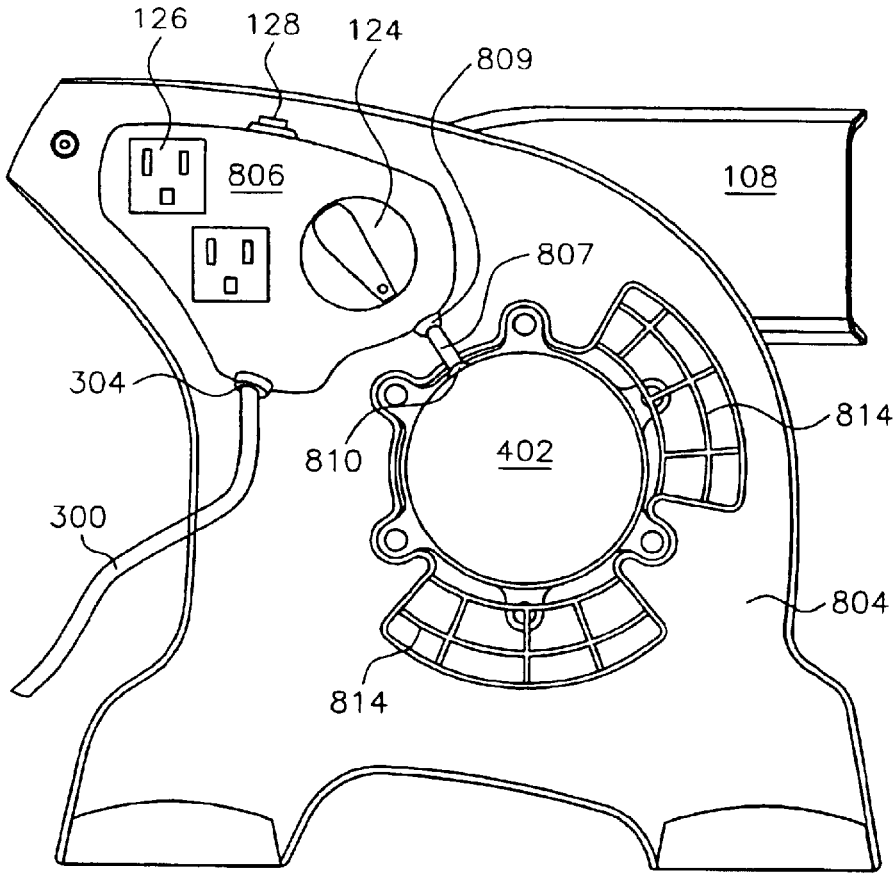
FIG. 8 is a left side view of a third exemplary embodiment of the present invention.

Referring now to FIG. 8, a third exemplary embodiment of the present invention is illustrated. In FIG. 8, motor 402 is mounted to sidewall member 804, at either an inside or outside portion thereof. Adjacent motor 402 is motor control assembly 806, also mounted to sidewall 804, and coupled to motor 402 via a short length of control cable 807 maintained in place with strain relief members 809, 810.

Figure 9:
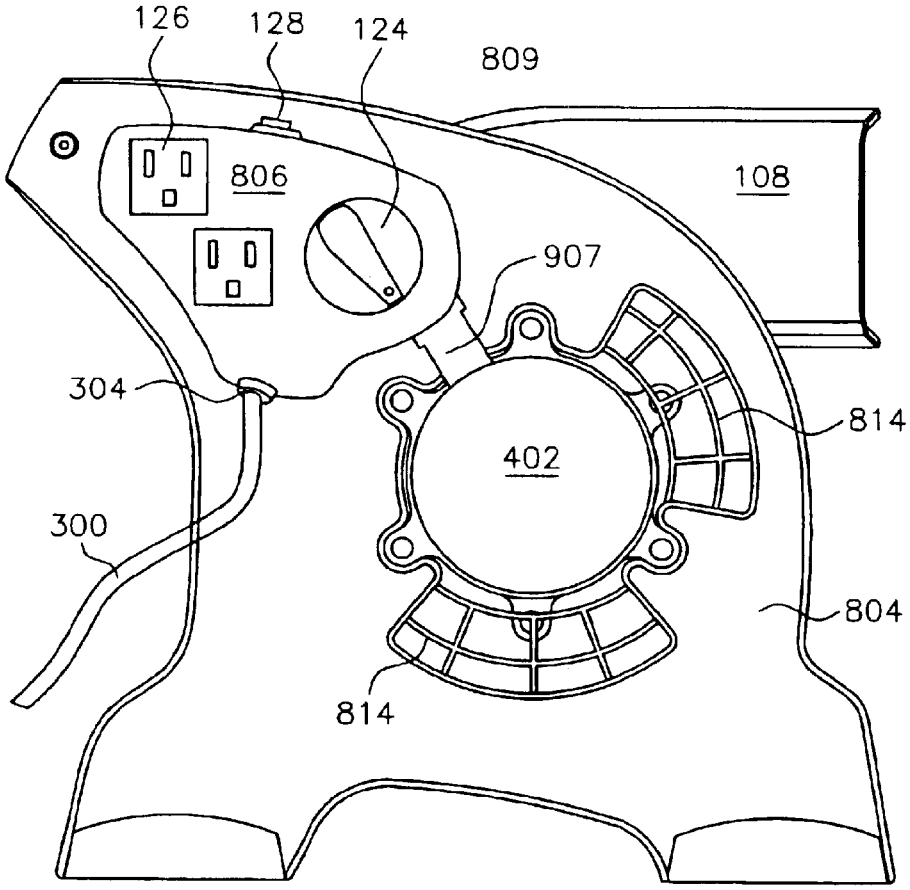
FIG. 9 is a left side view of a fourth exemplary embodiment of the present invention.

Referring now to FIG. 9, a fourth exemplary embodiment of the present invention is illustrated. This embodiment is similar to the third exemplary embodiment except for the use of coupling member 907 between motor control assembly 806 and motor 402. Coupling member 907 may be a sleeve or conduit formed from a polymer or a metal, for example. The use of coupling 907 protects the wiring (not shown) passing between motor 402 and motor control assembly 806.

The third and fourth exemplary embodiments are each similar to the first exemplary embodiment, in that motor control assembly includes motor controller 114 with power cord 300 coupled to motor control assembly 806 via strain relief 304. Optionally, motor control assembly 806 may include auxiliary power outlet(s) 126 and safety device 128.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A portable electrical blower assembly comprising:

a pair of sidewall members spaced apart and substantially parallel to one another;

an air director disposed between the pair of sidewall members, the air director being rotatable with respect to the pair of sidewall members about an axis of rotation substantially orthogonal to the pair of sidewall members;

a motor control assembly coupled to an outside surface of one of the pair of sidewall members, the motor control assembly comprising:

a motor control housing defining an interior space;

a motor controller at least partially disposed within the motor control housing;

a motor adjacent the motor control housing and coupled to at least one of the sidewall members and the motor control housing;

a plurality of wires connected to the at least one of i) the motor controller and/or ii) the motor, at least an extent of the plurality of wires disposed within the interior space of the motor control assembly.

2. The blower assembly according to claim 1, wherein the air director is rotatable through at least 180 degrees.

3. The blower assembly according to claim 1, wherein the air director is rotatable through about 270 degrees.

4. The blower assembly according to claim 1, wherein the air director is rotatable through about 360 degrees.

5. The blower assembly according to claim 1, further comprising detents disposed in at least one of the pair of sidewall members, the detents providing a plurality of positive stops for rotation of the air director.

6. The blower assembly according to claim 5, wherein the detents are configured in a substantially circular configuration at an interval of between about 5 and 15 degrees.

7. The blower assembly according to claim 1, further comprising detents disposed on the air director, the detents providing a plurality of positive stops for rotation of the air director.

8. The blower assembly according to claim 1, further comprising a cross member coupled to one or more of the pair of sidewall members, wherein the air director rotates with respect to the cross member.

9. The blower assembly according to claim 8, wherein the cross member includes at least a portion of a handle, one or more of the pair of sidewall members and the handle formed as a unitary part.

10. The blower assembly according to claim 8, wherein the cross member is free of electrical wiring.

11. The blower assembly according to claim 8, wherein the cross member is coupled between the pair of sidewall members, the sidewall members and the cross member formed as a unitary part.

12. The blower assembly according to claim 8, further comprising an axis of rotation about which the air director rotates, wherein said cross member is located radially outward of an envelope defined between said axis of rotation and an outermost portion of the air director, and wherein the air director is able to rotate about the axis of rotation by about 360 degrees without contacting the cross member.

13. The blower assembly according to claim 1, further comprising a handle coupled between the sidewall members, wherein the air director rotates with respect to handle.

14. The blower assembly according to claim 1, wherein at least one of the sidewall members includes a handle and a mounting means, the sidewall members, the handle and the mounting means formed as a unitary part.

15. The blower assembly according to claim 1, wherein at least one of i) the sidewall members, ii) the motor control housing, and/or iii) the air director are formed from a polymer.

16. The blower assembly according to claim 1, wherein at least one of i) the sidewall members, ii) the motor control housing, anchor iii) the air director are formed from a metal.

17. The blower assembly according to claim 1, wherein the motor control assembly further includes:

at least one auxiliary power outlet; and at least one safety device connected to the least one auxiliary power outlet, the plurality of wires connected to the at least one of i) the at least one auxiliary power outlet, ii) the motor controller, and/or iii) the at least one safety device.

18. The blower assembly according to claim 1, wherein the motor and the plurality of wiring are substantially stationary during a rotation of the air director.

19. The blower assembly according to claim 1, further comprising an opening in one of the pair of sidewall members, wherein the motor further comprises an output shaft and at least a portion of one of the motor and the output shaft is positioned at least partially within said opening in one of the pair of sidewall members.

20. The blower assembly according to claim 1, wherein the motor is positioned at least partially within the interior space of the motor control assembly.

21. The blower assembly according to claim 1, further comprising positioning means.

22. The blower assembly according to claim 21, wherein the positioning means includes at least one wheel.

23. The blower assembly according to claim 21, wherein the positioning means includes at least a pair of wheels.

24. The blower assembly according to claim 1, further comprising a fan assembly directly coupled to the motor, the fan assembly disposed within the air director.

25. The blower assembly according to claim 24, wherein the fan assembly includes a plurality of blades spaced apart from one another in a substantially parallel configuration.

26. The blower assembly according to claim 24, wherein the fan assembly includes a first plurality of blades and a second plurality of blades, each blade of the respective plurality of blades spaced apart from one another in a substantially parallel configuration, the second plurality of blades offset from the first plurality of blades by a predetermined distance.

27. The blower assembly according to claim 26, further comprising a partition disposed between the first plurality of blades and the second plurality of blades.

28. The blower assembly according to claim 27, further comprising a first air intake adjacent a first one of the pair of sidewall members and a second air intake adjacent a second one of the pair of sidewall members, the first air intake providing air for the first plurality of blades and the second air intake providing air for the second plurality of blades.

29. The blower assembly according to claim 28, wherein at least one of the first air intake and/or the second air intake is stationary with respect to the rotation of the air director.

30. The blower assembly according to claim 28, wherein one of the air intakes is stationary with respect to the rotation of the air director and the other air intake rotates in conjunction with the air director.

31. The blower assembly according to claim 27, wherein the motor is coupled to the partition.

32. The blower assembly according to claim 27, further comprising a first air intake disposed within a first one of the pair of sidewall members and a second air intake adjacent a second one of the pair of sidewall members, the first air intake providing air for the first plurality of blades and the second air intake providing air for the second plurality of blades.

33. The blower assembly according to claim 1, wherein the motor is stationary with respect to a rotation of the air director.

34. The blower assembly according to claim 1, further comprising mounting means adaptable for mounting the blower assembly on at least one of a substantially horizontal surface and/or a substantially vertical surface.

35. The portable electrical blower assembly according to claim 1, wherein the motor is a non-ventilated electric motor.

36. The portable electrical blower assembly according to claim 1, further comprising a front opening and a rear opening both of which extend vertically upward from proximate a support surface, the front edges of the pair of the sidewall members defining the front opening and the rear edges of the pair of sidewall members defining the rear opening, wherein the air director is capable of discharging a flow of air substantially unimpeded through one of the front opening and the rear opening.

37. The portable electric blower assembly according to claim 1, wherein the motor control housing is formed integral with at least one of the pair of sidewall members.

38. A portable electrical blower assembly comprising:

air directing means;

at least one support means supporting the air directing means;

motor control means attached to one of the support means; and handle means either coupled to or formed integral with the at least one support mean, and the air directing means being rotatably coupled to the at least one support means, the air directing means being rotatable with respect to the at least one support means, the motor control means, and/or the handle means.

39. The portable blower assembly according to claim 38, further comprising means for repositioning the portable blower assembly on a supporting surface.

40. The portable blower assembly according to claim 38, further comprising means for mounting the portable blower assembly on a supporting surface.

41. The portable blower assembly according to claim 38, further comprising means for providing a supply of air to the air directing means.

42. The portable blower assembly according to claim 38, further comprising means for providing auxiliary power from said motor control means.

43. A portable electrical blower assembly comprising:

at least a pair of spaced-apart substantially vertically extending sidewall members defining a space therebetween;

an air director rotatably disposed within the space between the pair of sidewall members;

at least one cross member extending between and coupled to the sidewall members;

a motor control assembly coupled to one of the sidewall members on a surface opposite the air director, the motor control assembly comprising:

i) a motor control housing defining an interior space, and ii) a motor controller at least partially disposed within the motor control housing;

a motor having at least one output shaft; and a fan blade assembly positioned within the air director and coupled to the output shaft of the motor, wherein the air director is rotatable with respect to the pair of sidewall members and the cross member about an axis of rotation oriented substantially orthogonal to the pair of sidewall members; and the cross member is either connected to or formed integral with at least one of the defined by the sidewall members.

44. A portable electrical blower assembly comprising:

at least one support means;

motor control means attached to one of the support means;

handle means either coupled to or formed integral with the at least one support means; and air directing means coupled to the at least one support means, the air directing means being rotatable with respect to the at least one support means, the motor control means, and/or the handle means;

wherein the support means further comprises a pair of spaced-apart substantially vertically extending sidewalls defining a space therebetween for receiving the air director means; and wherein the handling means further comprises a cross member connected to or formed integral with at least one of the sidewalls and extending in a direction substantially orthogonal to a plane defined by the sidewalls.

45. A portable air circulator device comprising:

a first sidewall;

a second sidewall spaced apart from the first sidewall end oriented substantially parallel to the first sidewall;

a space defined by a distance between the first sidewall and the second sidewall;

an air director disposed within the space and rotatably coupled to the first sidewall and the second sidewall, the air director having an axis of rotation oriented substantially orthogonal to the first and second sidewalls, the air director being capable of rotating about the axis of rotation;

at least one opening defined between respective peripheral edges of the first sidewall and the second sidewall, the at least one opening extending about the peripheral edges of the first sidewall and the second sidewall;

at least one cross member extending between and connecting the first sidewall to the second side wall, the at least one cross member located at a distance radially outward from the axis of rotation of the air director such that the at least one cross member does not interfere with the rotation of the air director;

a motor having at least one output shaft;

a fan blade assembly positioned within the air director and coupled to the output shaft of the motor;

a motor controller for controlling an operation of the motor, the motor controller positioned proximate the motor;

a plurality of wires electrically connecting the motor controller and the motor, the plurality of wires remaining substantially stationary with respect to the motor and the motor controller during rotation of the air director; and an air outlet in the air director for discharging a flow of exhaust air from the air director, the exhaust flow being in a direction that is substantially orthogonal to the axis of rotation of the air director.

46. The portable air circulator device according to claim 45, wherein said air director is rotatable with respect to the sidewalls such that the air outlet can be positioned over an angular range between 0 and 360 degrees.

47. The portable air circulator device according to claim 45, wherein said at least one cross member further comprises a handle far use in transporting the portable air circulator from one location to another, and wherein the one or more cross members are stationary with respect to the rotatable air director.

48. The portable air circulator device according to claim 45, wherein the at least one cross member further comprises one or more feet for supporting the portable air circulator device on a mounting surface, and wherein the one or more feet are stationary with respect to the rotatable air director.

49. The portable air circulator device according to claim 45, wherein the motor is connected to one or more of the first sidewall and/or the second sidewall and the motor controller is connected to an exterior of the same sidewall to which the motor is connected.

50. The portable air circulator device according to claim 45, wherein the motor is connected to the air director and the motor controller is connected to the air director, wherein the motor, the motor controller, and the plurality of wires rotate with the air director during rotation of the air director.

51. The portable air circulator device according to claim 45, wherein the motor further comprises a single output shaft, and wherein the motor is mounted to one of the sidewalls and at least a portion of the output shaft extends through an opening in the air director into the air director.

52. The portable air circulator device according to claim 45, wherein the motor further comprises dual output shafts, and wherein the motor is mounted within the air director and the motor controller is mounted on the air director.

53. A portable electrical blower assembly comprising:

a free-standing support chassis having at least one side wall;

a motor connected to the at least one side wall;

a motor controller electrically coupled to the motor by a plurality of wires; and an air director rotatably coupled to the support chassis, the air director being rotatable with respect to the support chassis, the motor, and the motor controller, wherein the motor and the motor controller do not impede rotation of the air director.

54. The portable electrical blower assembly according to claim 53, wherein the motor controller is connected to the at least one side wall on a surface opposite the air director and proximate the motor.

55. The portable electrical blower assembly according to claim 53, wherein the motor controller is positioned on a casing of the motor.

56. The portable electrical blower assembly according to claim 53, wherein the motor controller is proximate a casing of the motor.

* * * * *